US010190744B2

(12) United States Patent
Shido et al.

(10) Patent No.: US 10,190,744 B2
(45) Date of Patent: Jan. 29, 2019

(54) VEHICULAR MARKER LAMP USING PLANAR LIGHT EMITTER

(71) Applicant: Koito Manufacturing Co., Ltd., Tokyo (JP)

(72) Inventors: Masaya Shido, Shizuoka (JP); Toru Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 57 days.

(21) Appl. No.: 15/364,435

(22) Filed: Nov. 30, 2016

(65) Prior Publication Data

US 2017/0159905 A1 Jun. 8, 2017

(30) Foreign Application Priority Data

Dec. 4, 2015 (JP) ..... 2015-237506
Sep. 28, 2016 (JP) ..... 2016-189283

(51) Int. Cl.

| | |
|---|---|
| ***F21V 5/02*** | (2006.01) |
| ***F21V 13/04*** | (2006.01) |
| ***F21S 43/40*** | (2018.01) |
| ***F21S 43/31*** | (2018.01) |
| ***F21S 45/50*** | (2018.01) |
| ***F21S 43/145*** | (2018.01) |
| ***F21S 43/20*** | (2018.01) |
| *F21Y 115/20* | (2016.01) |

(52) U.S. Cl.

CPC ..... *F21S 43/40* (2018.01); *F21S 43/145* (2018.01); *F21S 43/26* (2018.01); *F21S 43/31* (2018.01); *F21S 45/50* (2018.01); *F21V 5/02* (2013.01); *F21V 13/04* (2013.01); *F21Y 2115/20* (2016.08)

(58) Field of Classification Search

CPC ..... F21S 43/40; F21S 43/145; F21S 43/26; F21S 43/31; F21Y 2115/15; F21Y 2115/20; G02B 6/0053; G02B 19/0028; B60Q 1/268; B60Q 1/26; F21V 5/02; F21V 5/04; F21V 13/02; F21V 13/04

USPC ..... 362/330

See application file for complete search history.

(56) References Cited

U.S. PATENT DOCUMENTS 3,711,704 A * 1/1973 Spiteri ..... F21S 43/26 362/337
4,120,018 A * 10/1978 Nagel ..... F21S 43/26 362/333
4,305,116 A * 12/1981 Huber ..... F21S 43/255 362/509

(Continued)

FOREIGN PATENT DOCUMENTS

JP 2011-150887 A 8/2011

*Primary Examiner* — Alan B Cariaso

(74) *Attorney, Agent, or Firm* — Abelman, Frayne & Schwab

(57) ABSTRACT

Provided is a vehicular marker lamp including a planar light emitter; and a lens including an incident portion formed on a surface facing the planar light emitter. A plurality of cross-sectionally triangular prisms are arranged in the incident portion in a state where the vertexes of triangular prisms face the planar light emitter side. Each of the prisms includes an incident surface formed on one surface in the arrangement direction to make a light from the planar light emitter is incident and a light-shielding portion formed on a surface opposite to the incident surface to shield incidence of the light from the planar light emitter.

11 Claims, 15 Drawing Sheets

(56) References Cited

U.S. PATENT DOCUMENTS

| | | | | | |
|---|---|---|---|---|---|
| 4,654,761 | A * | 3/1987 | Walsh | F21S 43/26 | 362/521 |
| 4,935,665 | A * | 6/1990 | Murata | H01L 25/0753 | 313/500 |
| 5,055,983 | A * | 10/1991 | Hunold | B60Q 1/2607 | 362/544 |
| 5,241,457 | A * | 8/1993 | Sasajima | B60Q 1/2696 | 362/503 |
| 5,323,302 | A * | 6/1994 | Bertling | F21V 5/002 | 362/308 |
| 5,383,102 | A * | 1/1995 | Jones | F21S 41/337 | 362/510 |
| 5,408,395 | A * | 4/1995 | Schmid | B60Q 1/2607 | 362/240 |
| 7,315,419 | B2 * | 1/2008 | Taira | G02B 5/1814 | 359/569 |
| 7,806,539 | B2 * | 10/2010 | Parker | F21V 5/00 | 362/19 |
| 9,869,445 | B2 * | 1/2018 | Baccarin | F21S 43/40 | |
| 2003/0147253 | A1 * | 8/2003 | Shy | B60Q 1/2665 | 362/545 |
| 2015/0375673 | A1 * | 12/2015 | Testai | B60Q 1/268 | 362/545 |

* cited by examiner

| x (°) | y (°) | z (°) |
|---|---|---|
| 10. 0 | 6. 6 | 35. 2 |
| 20. 0 | 13. 2 | 28. 6 |
| 30. 0 | 19. 5 | 22. 3 |
| 40. 0 | 25. 4 | 16. 4 |
| 50. 0 | 30. 7 | 11. 1 |
| 60. 0 | 35. 3 | 6. 5 |
| 70. 0 | 38. 8 | 3. 0 |
| 80. 0 | 41. 0 | 0. 8 |
| 90. 0 | 41. 8 | 0. 0 |

| Angle between lens body and vehicle lateral side | | Light emission angle (x) | Incident surface angle (z) | Critical Incident surface angle (z) |
|---|---|---|---|---|
|   | θ = 0°<br>Parallel | 45° | 15° | 6. 5° |
|   | θ = 10°<br>Rearward | 55° | 8° | 3° |
|   | θ = 20°<br>Rearward | 65° | 5° | 0. 8° |

VEHICULAR MARKER LAMP USING PLANAR LIGHT EMITTER

CROSS-REFERENCE TO RELATED APPLICATIONS

This application is based on and claims priority from Japanese Patent Application Nos. 2015-237506 and 2016-189283, filed on Dec. 4, 2015, and Sep. 28, 2016, respectively, with the Japan Patent Office, the disclosures of which are incorporated herein in their entireties by reference.

TECHNICAL FIELD

The present disclosure relates to a vehicular marker lamp using a planar light emitter to emit a light from the planar light emitter toward a periphery of a vehicle.

BACKGROUND

Conventionally, a vehicle lamp has been known in which a planar light emitter is used as a light source. For example, Japanese Patent Laid-Open Publication No. 2011-150887 discloses a lamp in which a lamp chamber is formed between a housing and a light-transmitting cover, a planar light emitter formed of an organic EL panel is provided in the lamp chamber, and a light from the planar light emitter is collected by a reflector and emitted to the rear side of the vehicle through the light-transmitting cover.

SUMMARY

A marker lamp that emits a light from a light source to a lateral side of a vehicle requires a light distribution in which a light of specific color (e.g., red) is suppressed from being emitted to a front side of the vehicle. For example, as illustrated in FIG. 1, in a case of side marker lamps 6 in a front portion of a vehicle body or side marker lamps 8 in a rear portion of the vehicle body, the maximum luminous intensity of the red light in a range of 60° to 90° toward the front side of the vehicle is limited to 0.25 cd or less by the regulations.

Thus, in the side marker lamps using a planar light emitter as a light source, it is necessary to make the light of the planar light emitter invisible from the front side of the vehicle. Hence, it is considered to cover the planar light emitter with a lens and form a light-shielding film in a part of the lens such that a light directed to the front side of the vehicle is shielded by the light-shielding film. However, according to this configuration, since the light-shielding film covers the light-emitting surface of the planar light emitter, there is a problem in that the light distribution amount to the lateral side of the vehicle decreases depending on the coverage area so that the marker lamp is darkened, and the appearance from the lateral side of the vehicle is deteriorated.

Therefore, an object of the present disclosure is to provide a vehicular marker lamp capable of efficiently distributing the light from the planar light emitter to the periphery of the vehicle.

Another object of the present disclosure is to provide a vehicular marker lamp capable of making the light of the planar light emitter invisible from the front side of the vehicle without deteriorating the appearance from the lateral side of the vehicle.

In order to solve the problem, the present disclosure provides a vehicular marker lamp including a planar light emitter, and a lens including an incident portion formed on a surface facing the planar light emitter, in which a plurality of cross-sectionally triangular prisms are arranged in the incident portion in a state where the vertexes of the prisms face the planar light emitter side, and each of the prisms includes an incident surface formed on one surface in the arrangement direction to make a light from the planar light emitter incident on the incident surface, and a light-shielding portion formed on a surface opposite to the incident surface to shield incidence of the light from the planar light emitter.

Here, the light-shielding portion of each of the prisms functions to shield a light directed in a predetermined direction from the planar light emitter. Examples of the light directed in a predetermined direction may include a light directed from the planar light emitter to the front side of the vehicle, a light directed from the planar light emitter to the upper side of the vehicle, and a light directed from the planar light emitter to the lateral side of the vehicle.

In any case, a reflective layer may be formed in the light-shielding portion of each of the prisms to reflect the light from the planar emitter toward an adjacent prism such that the light emitted from the planar light emitter is efficiently distributed in a predetermined direction. In the same point of view, the incident surface of each of the prisms may be formed on a surface including a longer side of each of the cross-sectionally triangular prisms.

According to an exemplary embodiment, in the vehicular marker lamp, the lens is provided with a light-emitting surface at an opposite side to the surface facing the planar light emitter, and the light-emitting surface is included in an outer surface of a vehicle windowpane. In this case, the lens may be formed integrally with the vehicle windowpane. The planar light emitter may be wholly transparent such that the visibility of the windowpane is not hindered by the marker lamp.

Further, the present disclosure provides a vehicular marker lamp includes a planar light emitter, and a lens including an incident portion formed on a surface facing the planar light emitter, in which the incident portion is provided with a plurality of cross-sectionally triangular prisms each having a vertex at the planar light emitter side, which are arranged in a longitudinal direction of a vehicle. Each prism includes a light-shielding portion formed on a surface directed toward a rear side of the vehicle to shield incidence of a light from the planar light emitter.

Here, the light-shielding portion may be formed on a surface including a shorter side of each of the cross-sectionally triangular prisms so as to be covered by the planar light emitter with a smaller area. That is, a plurality of prisms may be formed in the incident portion such that the surface of each of the prisms directed toward the rear side of the vehicle has a smaller area than that of the surface directed toward the front side of the vehicle. The light of the planar light emitter may be efficiently used in this manner.

Similarly, in order to enhance the utilization efficiency of the light, a reflective layer may be formed in the light-shielding portion such that the light from the planar light emitter is reflected toward an adjacent prism by the reflective film.

Further, in the vehicular marker lamp of the present disclosure, the lens is provided with a projection in a region excluding the prisms on the surface facing the planar light emitter to assemble the planar light emitter. With this configuration, the lens in which the surface facing the planar light emitter becomes uneven by the prisms may be assembled to the planar light emitter without trouble.

In this case, the planar light emitter may be provided with an assembly hole through which the projection passes, in a non-light-emitting region that does not face the prisms. Alternately, a plate including an assembly hole through which the projection passes may be used such that the planar light emitter is sandwiched between the lens and the plate. In either case, the lens and the planar light emitter may be easily assembled using a means such as, for example, heat caulking, without damaging the planar light emitter.

According to the vehicular marker lamp of the present disclosure, a plurality of prisms are arranged in the incident portion of the lens, and one surface of each of the prisms in the arrangement direction is configured as an incident surface, and a surface opposite to the incident surface is configured as a light-shielding portion. Therefore, there is an effect that the light from the planar light emitter may be efficiently distributed to the periphery of the vehicle by shielding a light directed to an unnecessary direction by the light-shielding portion, and causing a light directed to a necessary direction to be incident on the incident surface.

According to the vehicular marker lamp of the present disclosure, a plurality of prisms are arranged in the incident portion of the lens, the vertex of each of the prisms is disposed at the planar light emitter side, and the light-shielding portion is formed on the surface of each of the prisms facing the rear side of the vehicle. Therefore, there is an effect that the light directed from the planar light emitter toward the front side of the vehicle may be shielded by the light-shielding portion to be invisible from the front side of the vehicle, and the light directed from the planar light emitter toward the lateral side of the vehicle may be increased, thereby enhancing the appearance of the marker lamp when viewed from the lateral side of the vehicle.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Figure 1:
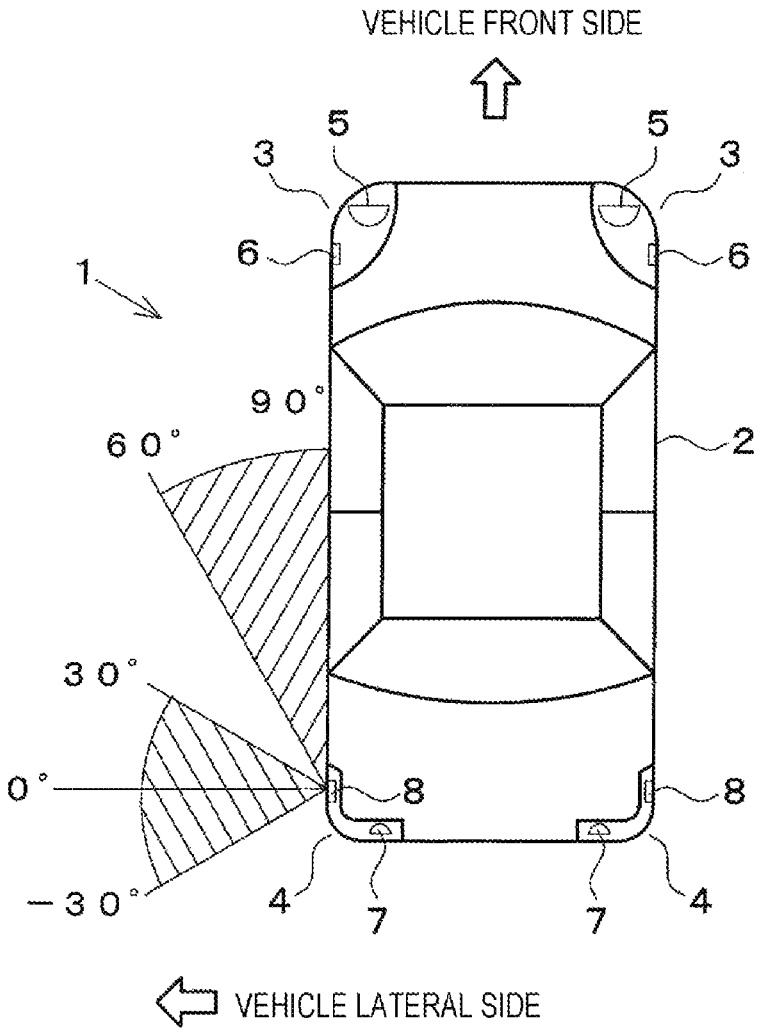
FIG. 1 is a plan view of an automobile illustrating an arrangement of side marker lamps.

Hereinafter, descriptions will be made on an exemplary embodiment in which the present disclosure is implemented in a side marker lamp of an automobile, with reference to the drawings. An automobile 1 illustrated in FIG. 1 is provided with a pair of left and right front side lamps 3 in the front portion of a vehicle body 2, and a pair of left and right rear side lamps 4 in the rear portion of the vehicle body 2. Each front side lamp 3 includes a head lamp 5 that illuminates the front region of the vehicle, and a side marker lamp 6 that illuminates the lateral region of the vehicle. Each rear side lamp 4 includes a tail lamp 7 that illuminates the rear region of the vehicle, and a side marker lamp 8 that illuminates the lateral region of the vehicle.

The front and rear side marker lamps 6, 8 are configured as vehicle marker lamps that notify the presence of the own vehicle to pedestrians or other vehicles on the left and right sides, to emit the light from the planar light emitter to the lateral sides of the vehicle in a predetermined angle range (e.g., an angle range of ±30°). A configuration of the side marker lamp 8 of the rear side lamp 4 will be described below, but the same configuration may be applied to the side marker lamp 6 of the front side lamp 3.

Figure 2:
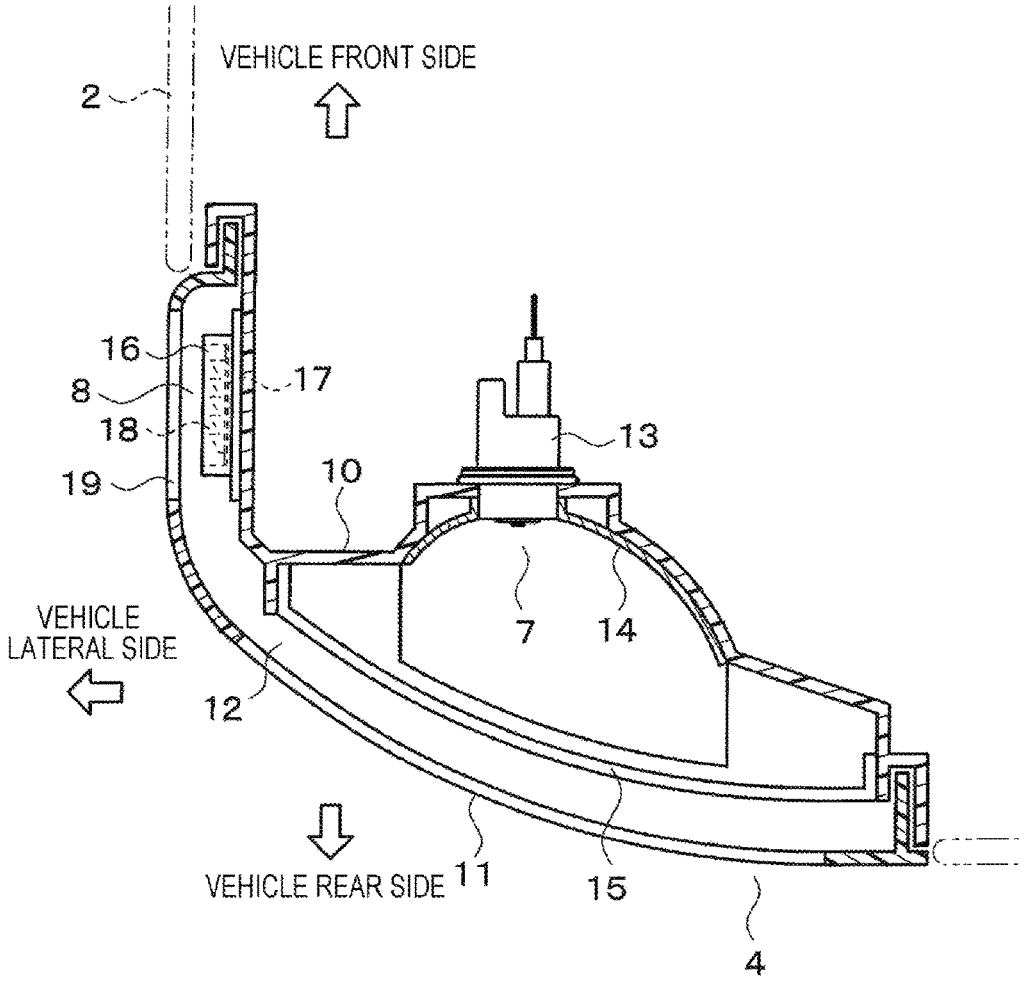
FIG. 2 is a vertical-sectional view illustrating a rear combination lamp equipped with a side marker lamp.

As illustrated in FIG. 2, a housing 10 of the rear side lamp 4 defines a lamp chamber 12 with a light-transmitting cover 11. Within the lamp chamber 12, the tail lamp 7 is installed to be directed to the rear side, and the side marker lamp 8 is installed to be directed to the lateral side. The tail lamp 7 is provided with an LED light source unit 13, a reflector 14, and an inner lens 15. The side marker lamp 8 is provided with a planar light emitter 17 and a lens 18 inside a casing 16 which is attached to the lamp housing 10. The side marker lamp 8 is configured to emit the light of the planar light emitter 17 from the lens 18 to the lateral side of the vehicle through a horizontal hole 18 of the light-transmitting cover 11.

Figure 3:
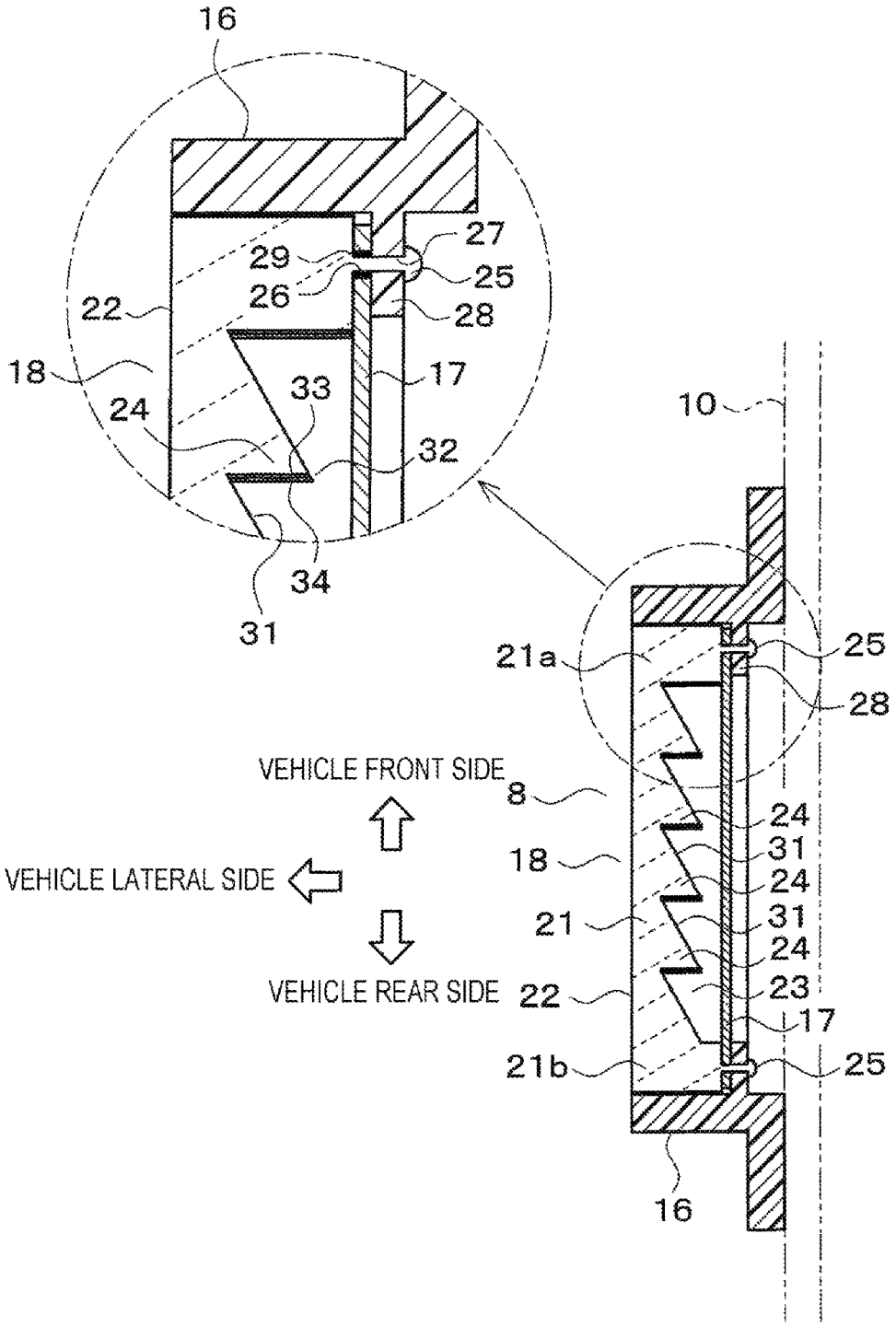
FIG. 3 is a cross-sectional view illustrating an assembly structure of the side marker lamp.
Figure 4:
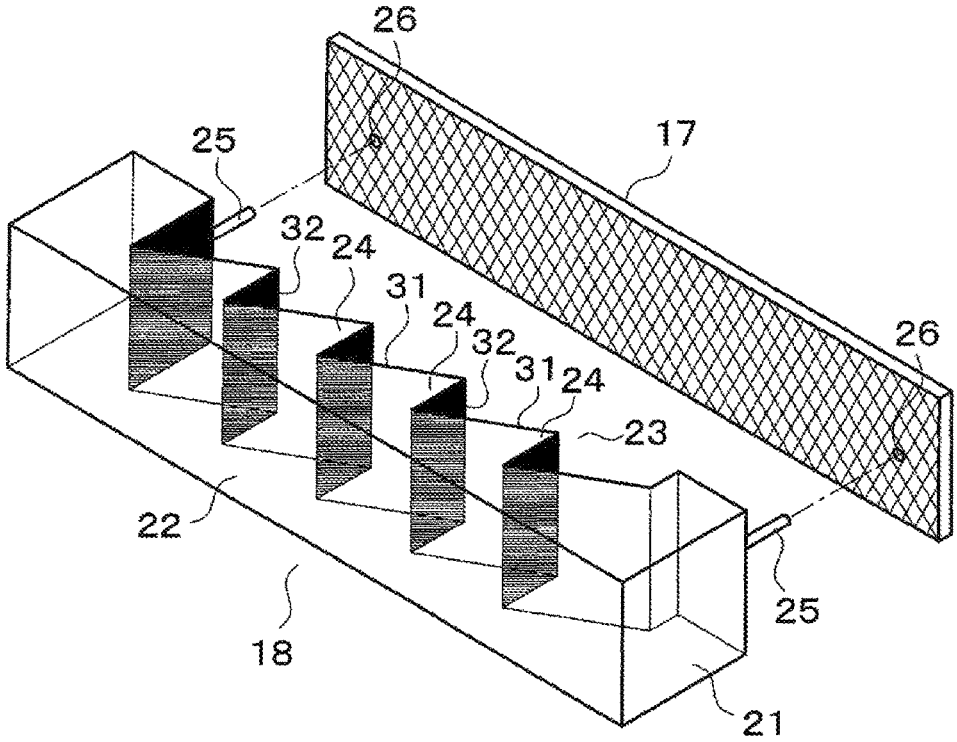
FIG. 4 is a perspective view illustrating a planar light emitter and a lens of the side marker lamp.

As illustrated in FIGS. 3 and 4, as the planar light emitter 17, a planar or curved light-emitting panel that generates a uniform visible light from the whole light-emitting region (e.g., an organic EL, an inorganic EL, a light guide plate, or a light-emitting plate on which a plurality of LEDs are arranged) has been used. A body 21 of the lens 18 is shaped to be long in the longitudinal direction of the vehicle with a transparent resin such as, for example, acrylic or polycarbonate. A surface of the lens body 21 facing the lateral side of the vehicle (front surface) is set as a light-emitting surface 22, and an incident portion 23 is formed on a surface at the opposite side (rear surface), that is, a surface facing the planar light emitter 17.

The light-emitting surface 22 is smoothly mirror-finished, and a plurality of cross-sectionally triangular prisms 24 are formed in the longitudinal direction of the vehicle. In a region excluding the prisms 24, projections 25 are formed in a front end portion 21*a* and a rear end portion 21*b* of the lens body 21 so as to project toward the lamp housing 10 side, thereby assembling the planar light emitter 17 and the lens 18 to each other. Then, the planar light emitter 17 and the lens 18 are assembled to the casing 16 by allowing the projections 25 to pass through holes 26 of the planar light emitter 17 and holes 27 perforated on the bottom wall 28 of the casing 16 and heat-caulking the tip ends of the projections 25.

In a case where an organic EL or an inorganic EL is used for the planar light emitter 17, the humidity resistance of the planar light emitter 17 may be enhanced by sealing the peripheral wall of the holes 26 with an insulating sealant 29 such that an electrode and a light-emitting layer sandwiched between two substrates (glass or resin) do not contact moisture in the air.

Each prism 24 of the lens 18 is formed integrally with the lens body 21 such that a vertex of the cross-sectional triangle is positioned at the planar light emitter 17 side. A surface of the prism 24 directed to the front side of the vehicle is an incident surface 31 on which the light from the planar light emitter 17 is incident, and a surface of the prism 24 directed to the rear side of the vehicle is formed with a light-shielding portion 32 that shields the incidence of the light from the planar light emitter 17. The light-shielding portion 32 is formed on a surface including a shorter side of the cross-sectionally triangular prism. And, for example, a black light-shielding layer 33 is coated on this surface, and a reflective layer 34 is coated on the light-shielding layer 33 so as to cover the light-shielding layer 33 from the rear side of the vehicle.

Figure 5:
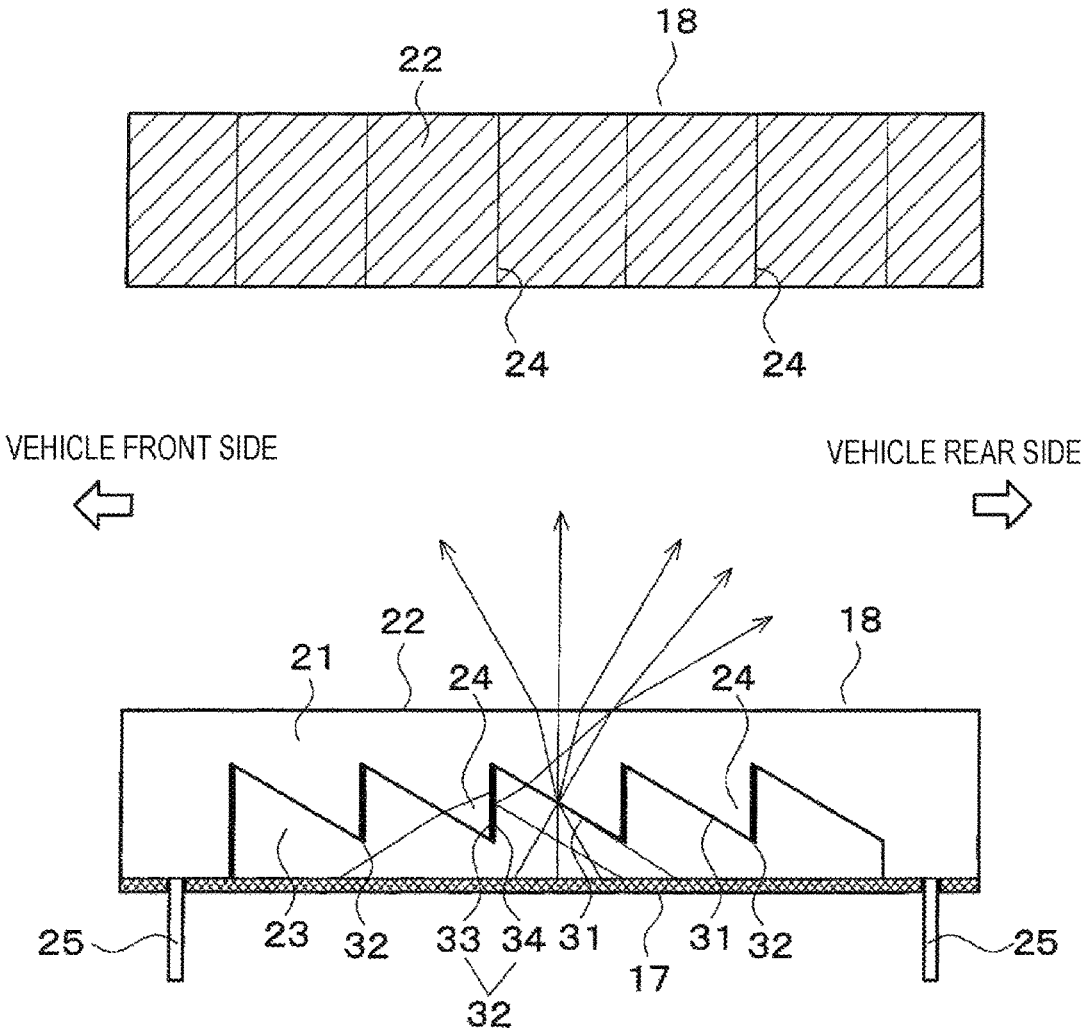
FIG. 5 is a ray diagram illustrating an optical action of prisms formed on the lens.

As illustrated in FIG. 5, in the exemplary embodiment, each prism 24 is formed in a cross-sectionally triangular shape such that the light-shielding portion 32 is covered by the planar light emitter 17 with the minimum area, and the light-shielding portion 32 is formed at a substantially right angle with respect to the arrangement direction of the prism 24. Therefore, at the time of turning on the side marker lamps 8, the peaks and valleys of the respective prisms 24 are represented as one straight line on the light-emitting surface 22 of the lens 18, so that the light from the light emitter 17 is uniformly emitted through the whole light-emitting surface 22. Thus, it is possible to enhance the appearance of the side marker lamp 8 when viewed from the lateral side of the vehicle.

Meanwhile, the incident surface 31 of each prism 24 faces the planar light emitter 17 with a broader area so that a large amount of the light is allowed to be incident from the planar light emitter 17 to the lens body 21. Then, the reflective layer 34 of the light-shielding portion 32 reflects a part of the light directed from the planar light emitter 17 to the front side of the vehicle, toward the prism 24 which is adjacent to the rear side, and the light-shielding layer 33 absorbs a part of the light directed from the planar emitter 17 to the rear side so as to suppress the part of the light from being reflected to the front side. Therefore, the light directed from the planar light emitter 17 to the front side of the vehicle may be shielded by the light-shielding portion 32, and the rest of the light may be emitted within a predetermined angle range of the lateral side of the vehicle.

Figure 6A:
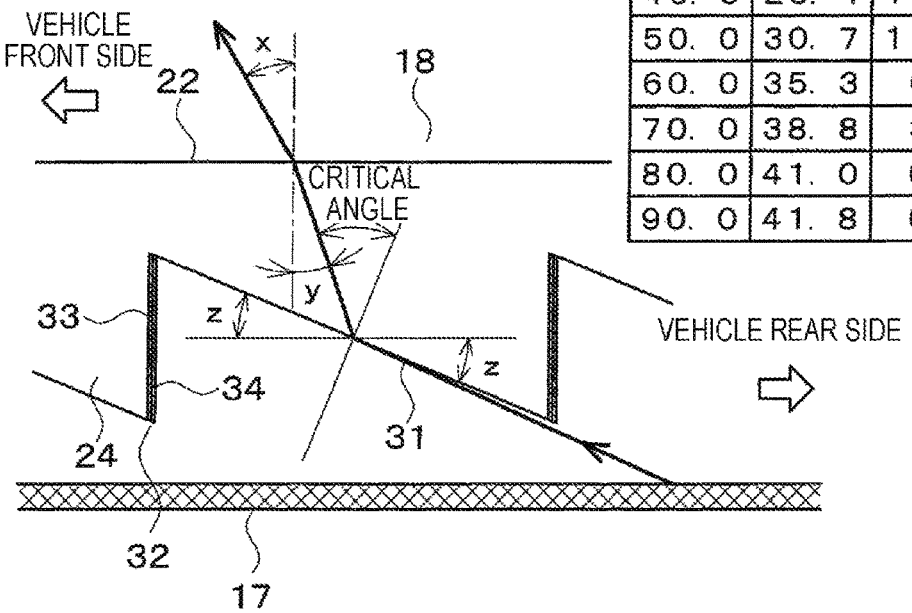
FIGS. 6A and 6B are explanatory views illustrating a relationship between a light emission angle (x) of the lens and an incident surface angle (z) of the prism.
Figure 6B:
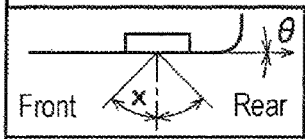
Figure 6B:
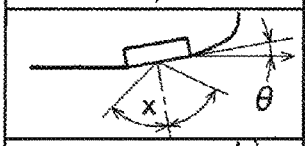
Figure 6B:
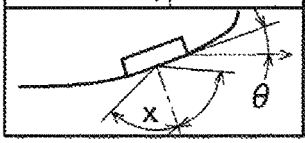

FIGS. 6A and 6B illustrate a relationship between a light emission angle (x) of the lens 18 and an angle (z) of the incident surface 31 of the prism 24. In order to set a required value for the light emission angle of the side marker lamp 8 to 30° toward the front side of the vehicle as illustrated in FIG. 1, an incident surface 31 of (z)=22.3° may be formed in the prism 24 of the acrylic lens 18 as illustrated in FIG. 6A. In this case, the light directed along the incident surface 31 from the planar light emitter 17 to the front side of the vehicle is incident on the lens body 21 from a part of the incident surface 31, refracted at an angle corresponding to the critical angle of the acrylic material (41.8°), and emitted from the light-emitting surface 22 of the lens 18 to the lateral side of the vehicle at an angle of (x)=30°, which corresponds to the required value.

The light emission angle (x) varies depending on the kind of the vehicle or the installation site of the side marker lamp 8. However, in a case of emitting a red light, the angle (z) of the incident surface 31 may be set to 35.2° to 6.5° such that the light emission angle (x) falls within a range of 10° to 60° in order to make the red light invisible at an angle within a range of 60° to 90° toward the front side of the vehicle according to the regulations. Particularly, the incident surface angle (z) may be set to 22.3° or less such that the light emission angle (x) becomes 30° or less from the viewpoint of further increasing the maximum luminous intensity of the red light at the lateral side of the vehicle. In addition, each of the light emission angle (x) and the incident surface angle (z) may be set to an intermediate value of the above-mentioned numeral values, in consideration of the regulations and the luminous intensity. Specifically, the actual values of the light emission angle (x) and the incident surface angle (z) may be set as illustrated in FIG. 6B depending on the angle (θ) between the surface of the lens 18 (the light-emitting surface 22) and the lateral surface of the vehicle body 2.

In FIG. 6B, (1) In a case where the lens surface is parallel to the lateral surface of the vehicle body (θ=0°), to make light emitted from the planar light emitter 17 in a range of (x)=−30° to 30°, and to make no light emitted in a range of (x)=60° to 90°, the angle (z) of the incident surface 31 is set to 15° such that the light emission angle (x) becomes 45° which is an intermediate value between 30° and 60°. The critical incident surface angle (z) when (x)=60° is 6.5° (see the table in FIG. 6B).

(2) In a case where the lens surface is directed to the rear side with an angle of 10° with respect to the lateral surface of the vehicle body, to make light emitted from the planar light emitter 17 in the range of (x)=−20° to 40°, and to make no light emitted in a range of (x)=70° to 90°, the angle (z) of the incident surface 31 is set to 8° such that the light emission angle (x) becomes 55° which is an intermediate value between 40° and 70°. The critical incident surface angle (z) of (x)=70° is 3°.

(3) In a case where the lens surface is directed to the rear side with an angle of 20° with respect to the lateral surface of the vehicle body, to make the light emitted from the planar light emitter 17 in a range of (x)=−10° to 50°, and to make no light emitted in a range of (x)=80° to 90°, the angle (z) of the incident surface 31 is set to 5° such that the light emission angle (x) becomes 65° which is an intermediate value between 50° and 80°. The critical incident surface angle (z) of (x)=80° is 0.8°.

Figure 7:
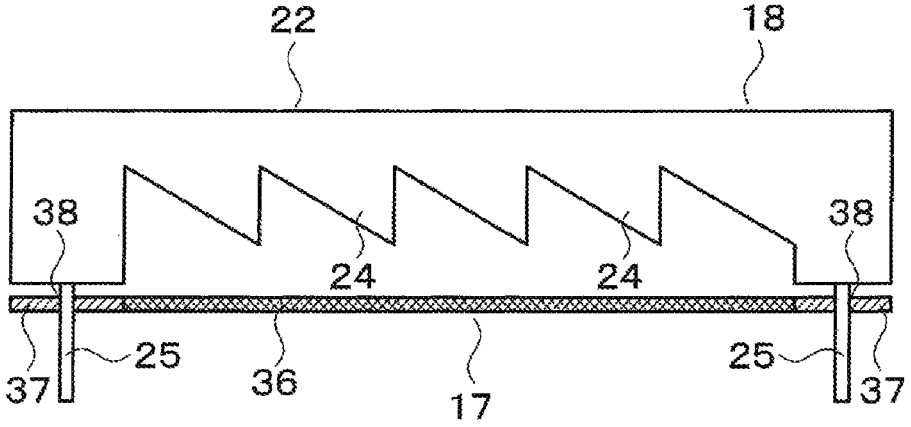
FIG. 7 is a cross-sectional view illustrating an assembly structure of the lens and the planar light emitter.
Figure 8:
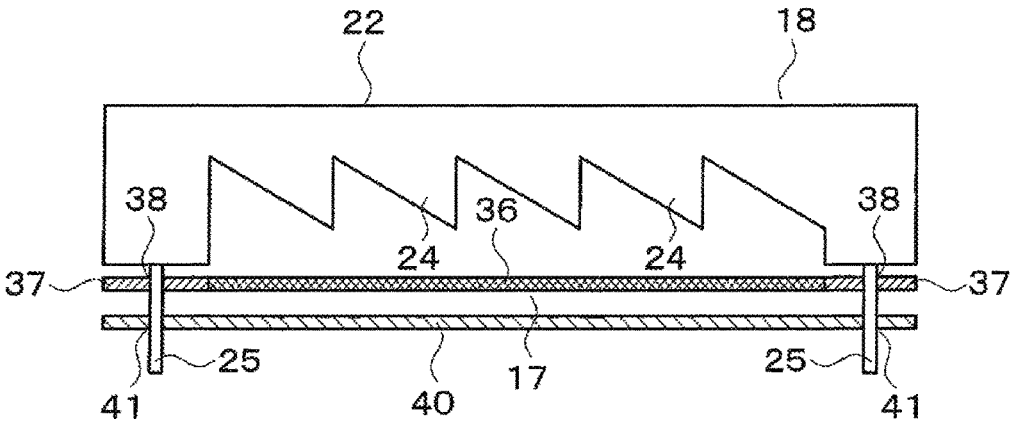
FIG. 8 is a cross-sectional view illustrating another assembly structure of the lens and the planar light emitter.
Figure 9:
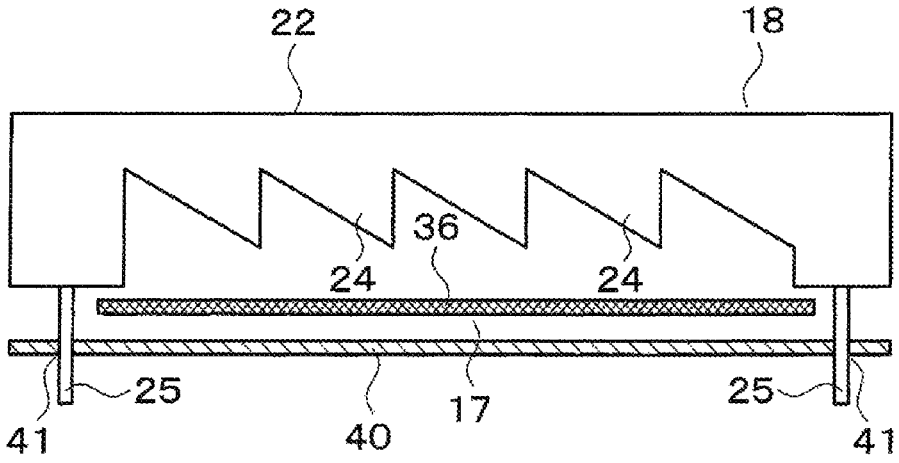
FIG. 9 is a cross-sectional view illustrating still another assembly structure of the lens and the planar light emitter.

FIGS. 7 to 9 illustrate different assembly structures of the planar light emitter 17 and the lens 18. The planar light emitter 17 illustrated in FIG. 7 includes a light-emitting region 36 that faces the prisms 24, non-light-emitting regions 37 that do not face the prisms 24, and assembly holes 38 are formed in the non-light-emitting regions 37 at both ends. Then, the projections 25 of the lens 18 pass through the assembly holes 38 and the holes 27 of the casing 16 (see, e.g., FIG. 3), and the planar light emitter 17 and the lens 18 are assembled to the casing 16 by heat-caulking of the projections 25.

In the planar light emitter 17 illustrated in FIG. 8, the non-light-emitting regions 37 are sandwiched between the lens 18 and a plate 40, and the light-emitting region 36 is protected by the plate 40. The plate 40 is provided with assembly holes 41 through which the projections 25 pass, and is assembled to the casing 16 together with the planar light emitter 17 by heat-caulking. In the planar light emitter 17 illustrated in FIG. 9, the non-light-emitting regions are removed so that the area of the planar light emitter 17 becomes smaller than that of the plate 40, and only the light-emitting region 36 is sandwiched between the lens 18 and the plate 40. According to the assembly structure, since no hole is formed in the light-emitting region 36, the planar light emitter 17 and the lens 18 may be readily assembled by heat-caulking without any heat damage to the light-emitting layer such as, for example, an organic EL.

Figure 10A:
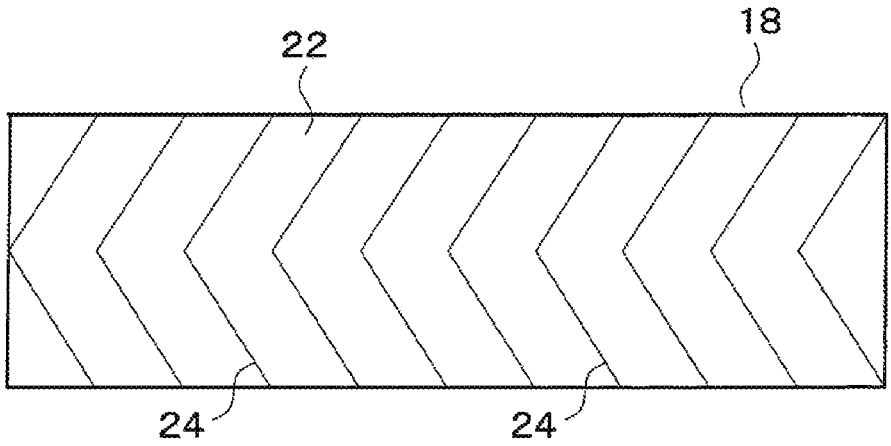
FIGS. 10A and 10B are front views of the lens illustrating an exterior appearance design using the prisms.
Figure 10B:
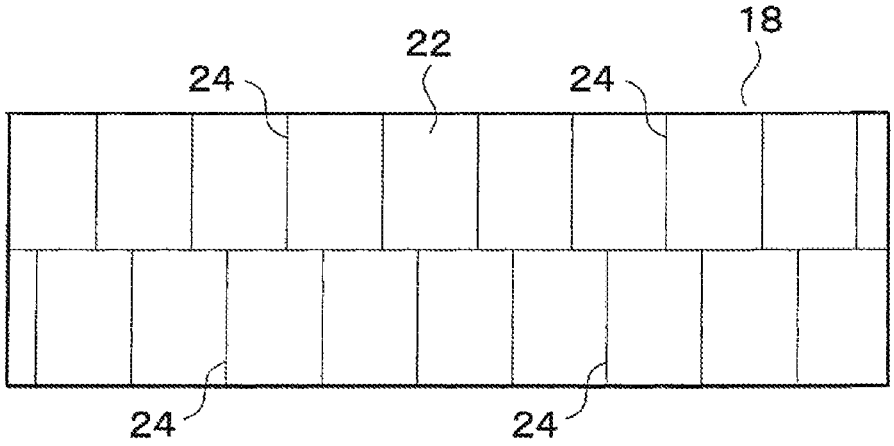

FIGS. 10A and 10B illustrate an exterior appearance design of the lens 18. In the lens 18 of FIG. 10A, a directionality may be imparted to the exterior appearance of the side marker lamp 8 by forming the plurality of prisms 24 in a shape bent to the front side of the vehicle or the rear side. In the lens 18 of FIG. 10B, the side marker lamp 8 may be made to look like a bright panel at the time of light-out by arranging the plurality of prisms 24 in a plurality of vertical columns. Besides, various exterior appearance designs may be created using the prisms 24.

Figure 11:
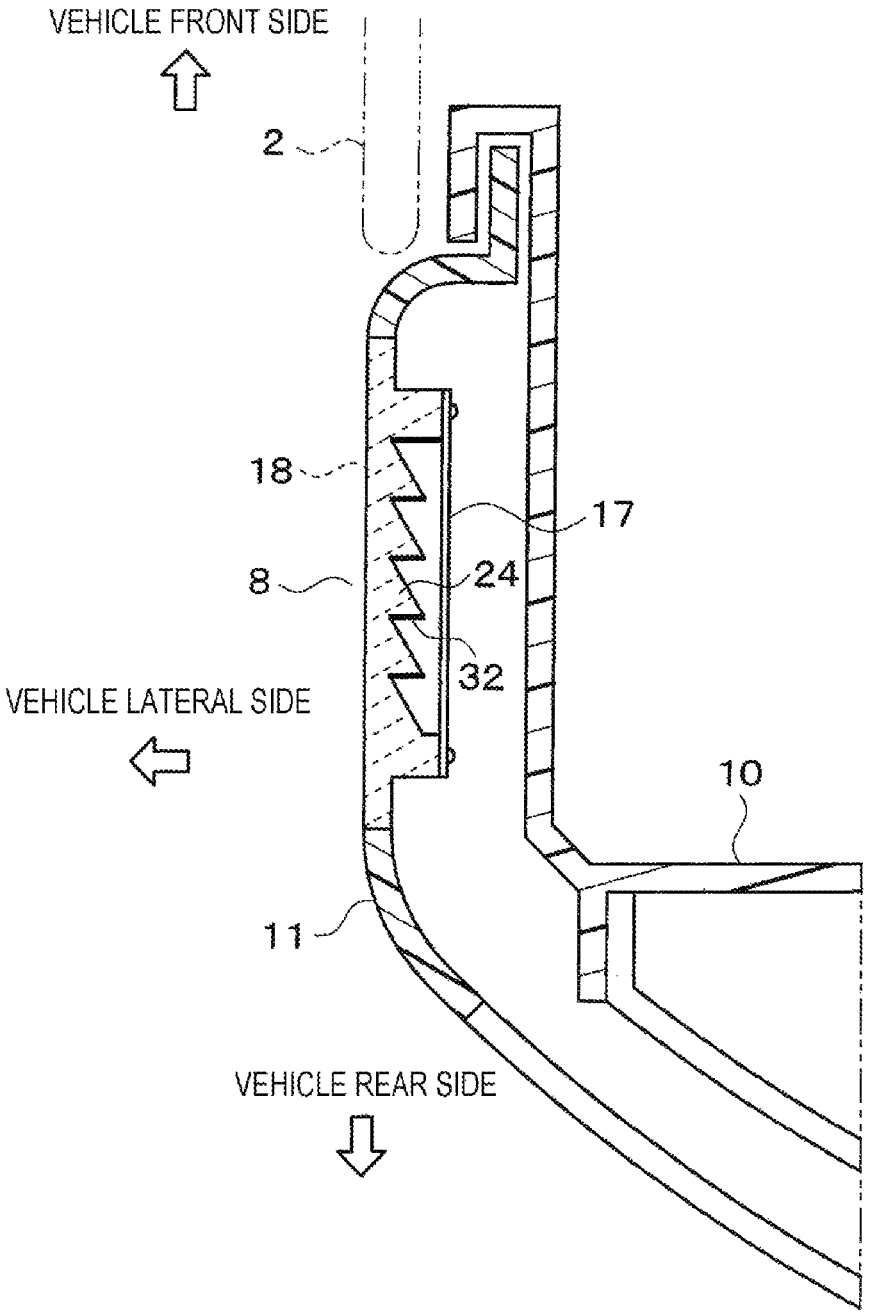
FIG. 11 is a cross-sectional view illustrating a side marker lamp provided integrally with a lamp outer lens.

The side marker lamp 8 illustrated in FIG. 2 is attached to the housing 10 of the vehicle lamp (the rear side lamp in FIG. 1) by the casing 16. However, as illustrated in FIG. 11, the side marker lamp 8 may be installed integrally with the light-transmitting cover or outer lens 11 of the vehicle lamp. Even with this configuration, it is possible to make the light of the planar light emitter 17 invisible from the front side of the vehicle by the light-shielding portion 32 of the prism 24. In addition, the shape or structure of each part may be appropriately changed, without departing from the scope of the present disclosure, by, for example, applying the configurations of the above exemplary embodiments to the side marker lamp 6 of the front side lamp 3 (see, e.g., FIG. 1) or other vehicular marker lamp.

Figure 12:
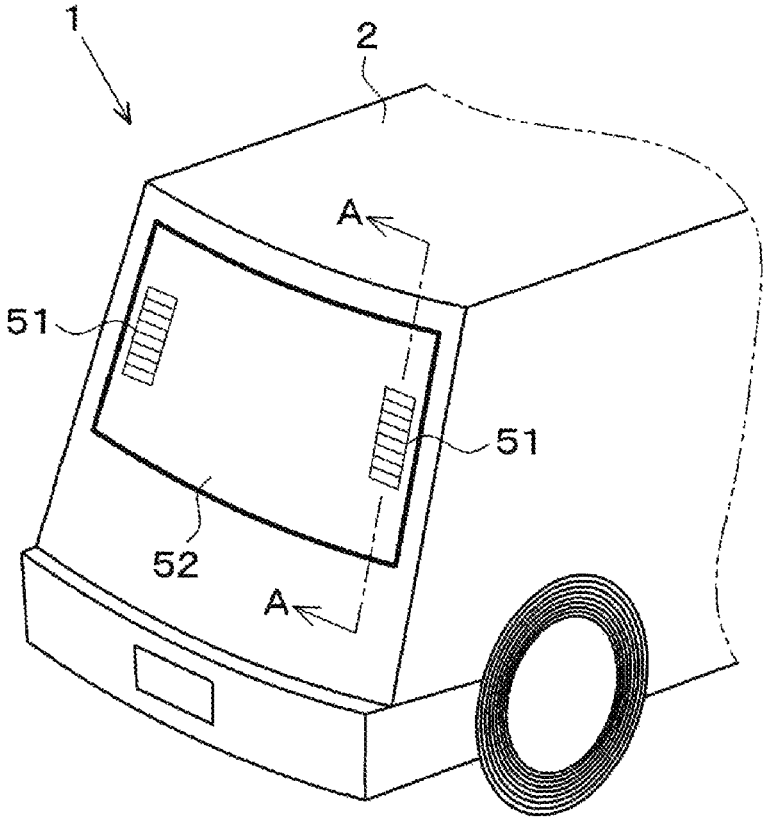
FIG. 12 is a perspective view of an automobile illustrating an arrangement of tail and stop lamps.
Figure 13:
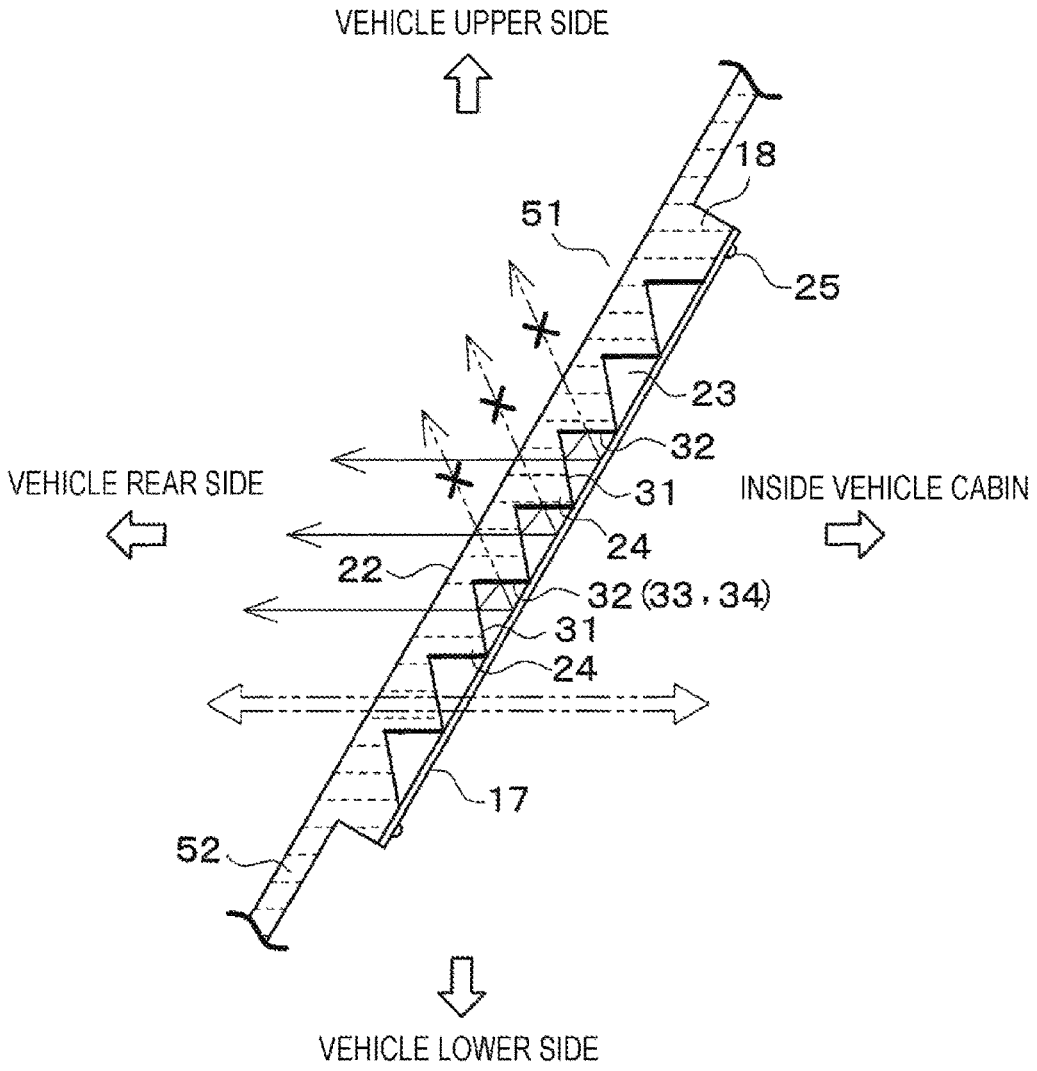
FIG. 13 is a cross-sectional view taken along the line A-A of FIG. 12.

FIGS. 12 and 13 illustrate an exemplary embodiment in which the present disclosure is applied to tail and stop lamps 51 of an automobile 1. The tail and stop lamps 51 are mounted on the left and right side portions of a rear windowpane 52, and includes a transparent planar light emitter 17 and a lens 18. The tail and stop lamps 51 are configured to emit the light from the planar light emitter 17 toward the rear side of the vehicle through the lens 18.

The planar light emitter 17 is formed of, for example, a wholly transparent organic EL panel in which transparent electrodes are used for a cathode and an anode. The planar light emitter 17 is configured not to disturb the view from the inside and the outside of the vehicle cabin at the time of turning off the lamps 51, as indicated by the chain line arrow in FIG. 13. Further, the planar light emitter 17 may be configured using a see-through organic EL with electrodes (e.g., anodes) thinned in a stripe shape (Japanese Patent Laid-Open Publication No. 2015-195173) such that the planar light emitter 17 does not emit light inside the vehicle cabin, but only emits light outside the vehicle cabin.

The lens 18 is made of a transparent material and formed integrally with the rear windowpane 52. The lens 18 includes an incident portion 23 on a surface facing the planar light emitter 17, and a light-emitting surface 22 directed to the rear side of the vehicle, on a surface opposite to the incident portion 23. The light-emitting surface 22 is included in the outer surface of the rear windowpane 52.

In the incident portion 23, a plurality of cross-sectionally triangular prisms 24 are arranged obliquely in the vertical direction in a state where the vertexes of the triangles face the planar light emitter 17. Each of the prisms 24 includes an incident surface 31 is formed on a surface directed to the inside of the vehicle cabin (a surface in the arrangement direction of the prisms) to make the light from the planar light emitter 17 incident on the incident surface 31, and a light-shielding portion 32 is formed on a surface directed to the lower side of the vehicle (a surface opposite to the incident surface 31) to shield incidence of the light from the planar light emitter 17.

Similarly to the exemplary embodiment disclosed above, the incident surface 31 is formed on a surface including a longer side of each of the cross-sectionally triangular prisms 24. The light-shielding portion 32 is provided with a light-shielding layer 33 and a reflective layer 34 on a surface including a shorter side of each of the prisms 24 (see, e.g., FIG. 3). And, the light-shielding layer 33 is configured to shield a light directed from the planar light emitter 17 to the upper side of the vehicle, and the reflective layer 34 is configured to cause the light to be incident on the incident surface 31 of an adjacent prism 24. Thus, according to the tail and stop lamps 51 of the exemplary embodiment, particularly, a light directed to an unnecessary direction (the upper side of the vehicle) may be changed to be directed to a necessary direction. Thus, the utilization efficiency of the light is enhanced, which is advantageous to distribute a brighter marker light to the rear side of the vehicle.

Figure 14:
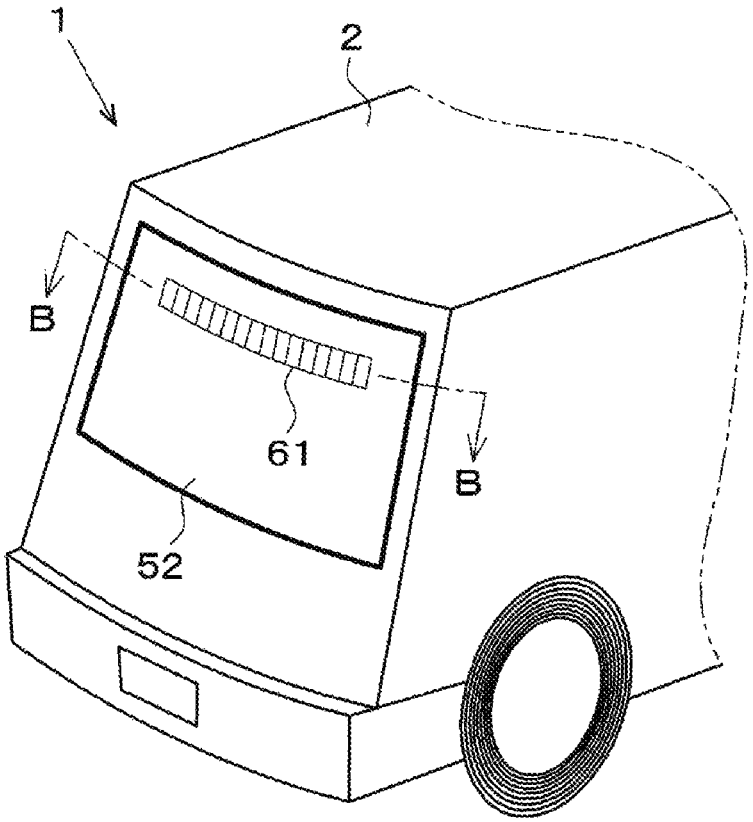
FIG. 14 is a perspective view of an automobile illustrating an arrangement of a high mount stop lamp.
Figure 15:
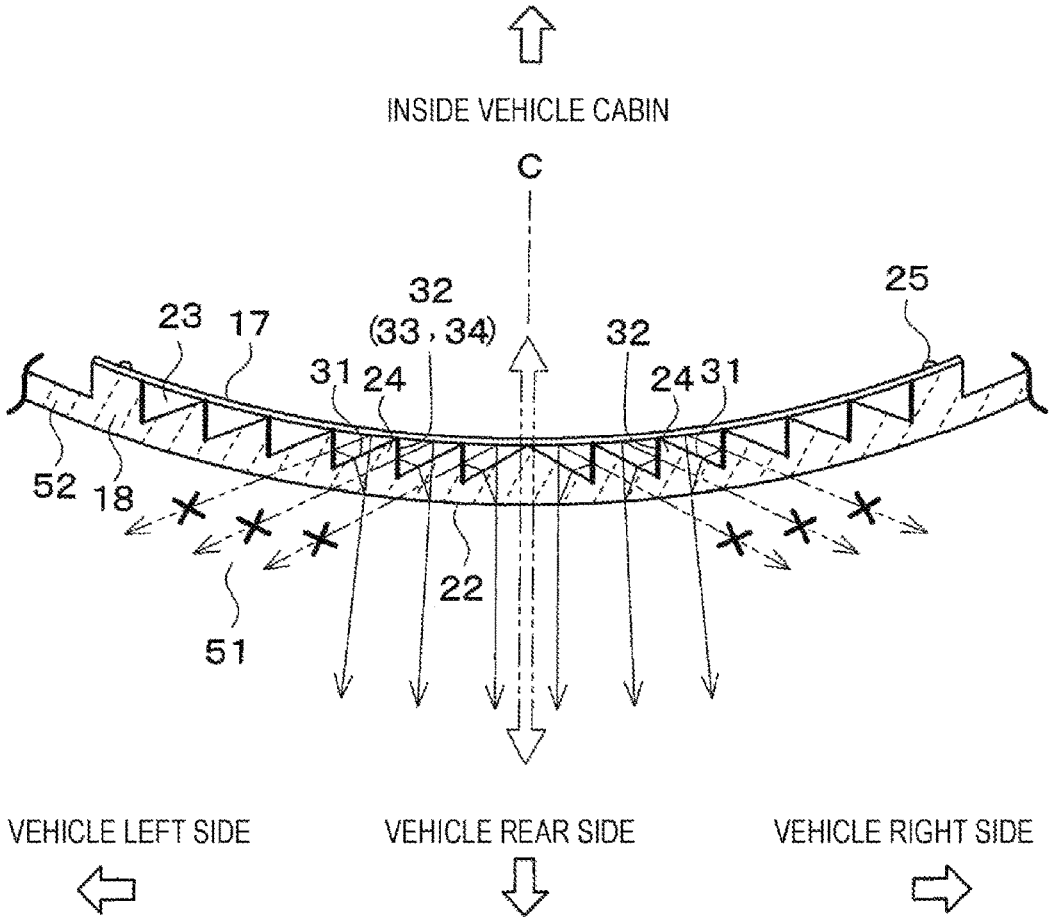
FIG. 15 is a cross-sectional view taken along the line B-B of FIG. 14.

FIGS. 14 and 15 illustrate an exemplary embodiment in which the present disclosure is applied to a high mount stop lamp 61 of the automobile 1. The high mount stop lamp 61 is mounted on the top side portion of the rear windowpane 52 and includes a transparent planar light emitter 17 and a lens 18 which are elongated in the horizontal direction. The high mount stop lamp 61 is configured to emit the light from the planar light emitter 17 toward the rear side of the vehicle through the lens 18.

The planar light emitter 17 is formed of a wholly transparent organic EL panel as described above. The planar light emitter 17 is configured not to disturb the view from the inside and the outside of the vehicle cabin at the time of turning off the lamp (see the chain line arrow in FIG. 15). The lens 18 is formed integrally with the rear windowpane 52 to be curved at the same curvature as that of the rear windowpane 52, and includes an incident portion 23 facing the planar light emitter 17 and a light-emitting surface 22 included in the outer surface of the rear windowpane 52. And, in the incident portion 23, a plurality of cross-sectionally triangular prisms 24 are arranged in the horizontal direction in a state where the vertexes thereof face the planar light emitter 17.

The plurality of prisms 24 are arranged to be bilaterally symmetrical about a central line C that extends in the longitudinal direction of the vehicle. Each of the prisms 24 includes an incident surface 31 formed on a surface directed to the inside of the vehicle cabin (a surface in the arrangement direction of the prisms) to cause the light from the planar light emitter 17 is incident on the incident surface 31, and a light-shielding portion 32 is formed on a surface directed to the central line C (a surface opposite to the incident surface 31) to shield incidence of the light from the planar light emitter 17.

The incident surface 31 is formed on a surface including a longer side of each of the prisms 24. The light-shielding portion 32 is provided with a light-shielding layer 33 and a reflective layer 34 on a surface including a shorter side of each of the prisms 24 (see FIG. 3). And, the light-shielding layer 33 is configured to shield a light directed from the planar light emitter 17 to the left and right sides of the vehicle, and the reflective layer 34 is configured to cause the light to be incident on the incident surface 31 of an adjacent prism 24. Thus, according to the high mount stop lamp 61 of the exemplary embodiment, particularly, a light directed to the lateral side of the vehicle may be changed to be directed to the rear side of the vehicle. Thus, the utilization efficiency of the light is enhanced, which is advantageous to distribute a brighter marker light to the rear side of the vehicle.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A vehicular marker lamp comprising:

a planar light emitter; and a lens coupled to the planar light emitter and including an incident portion formed on a surface facing the planar light emitter, wherein a plurality of cross-sectionally triangular prisms are arranged in the incident portion in a state where vertexes of the triangular prisms face the planar light emitter, and each of the prisms includes an incident surface formed on one surface and arranged along the incident portion to make a light from the planar light emitter incident on the incident surface, and a light-shielding portion formed on a surface opposite to the incident surface to shield incidence of the light from the planar light emitter, wherein the light-shielding portion is formed at a substantially right angle with respect to the planar light emitter.

2. The vehicular marker lamp of claim 1, wherein the light-shielding portion of each of the prisms is configured to shield a light directed in a predetermined direction from the planar light emitter.

3. The vehicular marker lamp of claim 1, wherein the light-shielding portion of each of the prisms includes a reflective layer that reflects the light from the planar light emitter toward an adjacent prism.

4. The vehicular marker lamp of claim 1, wherein the incident surface of each of the prisms is formed on a surface including a longer side of each of the cross-sectionally triangular prisms.

5. The vehicular marker lamp of claim 1, wherein the lens includes a light-emitting surface at an opposite side to the surface facing the planar light emitter, and the light-emitting surface is included in an outer surface of a vehicle windowpane.

6. The vehicular marker lamp of claim 5, wherein the lens is formed integrally with the vehicle windowpane.

7. The vehicular marker lamp of claim 5, wherein the planar light emitter is transparent as a whole.

8. A vehicular marker lamp comprising:

a planar light emitter; and a lens coupled to the planar light emitter and including an incident portion formed on a surface facing the planar light emitter, wherein the incident portion includes a plurality of cross-sectionally triangular prisms each having a vertex facing the planar light emitter, the prisms being arranged along a longitudinal direction of a vehicle, and a light-shielding portion is formed on a surface of each of the prisms, which is directed toward a rear side of the vehicle, to shield incidence of a light from the planar light emitter, wherein the light-shielding portion is formed at a substantially right angle with respect to the planar light emitter.

9. The vehicular marker lamp of claim 8, wherein the lens includes a projection in a region excluding the prisms on the surface facing the planar light emitter to assemble the planar light emitter.

10. The vehicular marker lamp of claim 9, wherein the planar light emitter includes an assembly hole through which the projection passes, in a non-light-emitting region that does not face the prisms.

11. The vehicular marker lamp of claim 9, further comprising:

a plate including, formed therein, an assembly hole through which the projection passes, wherein the planar light emitter is sandwiched between the lens and the plate.

* * * * *